US005692435A

United States Patent [19]

Nissen

[11] Patent Number: 5,692,435

[45] Date of Patent: Dec. 2, 1997

[54] DEWATERING PRESS

[75] Inventor: Robert E. Nissen, Golden, Colo.

[73] Assignee: Serpentix Conveyor Corp., Westminster, Colo.

[21] Appl. No.: 668,057

[22] Filed: Jun. 19, 1996

[51] Int. Cl.[6] ..... B30B 9/06

[52] U.S. Cl. ..... 100/126; 100/218; 100/244; 100/264; 100/289

[58] Field of Search ..... 100/110, 116, 100/125–127, 218, 244, 264, 289

[56] References Cited

U.S. PATENT DOCUMENTS

| | | | |
|---|---|---|---|
| 1,180,959 | 4/1916 | Turner | 100/244 |
| 1,345,963 | 7/1920 | Guntuñz Y Santos | 100/127 |
| 2,454,256 | 11/1948 | Myers | 100/218 |
| 3,073,239 | 1/1963 | Cowan et al. . | |
| 3,768,398 | 10/1973 | Ullman, Jr. | 100/244 |
| 4,066,548 | 1/1978 | Olson et al. . | |
| 4,265,171 | 5/1981 | Busse et al. . | |
| 4,691,628 | 9/1987 | Simpson . | |
| 4,861,492 | 8/1989 | Lehmkuhl et al. . | |
| 4,971,693 | 11/1990 | Akesaka . | |
| 5,160,440 | 11/1992 | Mérai . | |
| 5,207,907 | 5/1993 | DeLons et al. . | |

OTHER PUBLICATIONS

Water Environment & Technology, "How Dry is Dry Enough?", May 1994 pp. 21–22.

*Primary Examiner*—Stephen F. Gerrity
*Attorney, Agent, or Firm*—Kyle W. Post

[57] ABSTRACT

A press frame has a floored portion that defines a pressing area and a floorless portion that defines a discharge area. The frame carries first and second squeezing elements that are moveable between the pressing area and discharge area. Only the first squeezing element is powered, and it can be driven selectively toward or away from the second squeezing element to press and discharge screenings. A linking device limits the maximum separation of the first and second squeezing elements so that the first element pulls the second, together with processed screenings, to the discharge area in a discharge cycle. An interposer limits the minimum separation of the first and second squeezing elements so that the powered element pushes the nonpowered element back to the pressing area after the discharge cycle.

9 Claims, 6 Drawing Sheets

DEWATERING PRESS

TECHNICAL FIELD

The invention generally relates to presses and more specifically to presses of the type having a box, frame, cage, or annular wall. Further, the invention relates to a press with drain means for expressed liquids, such as drainage through or along the pressure surface or through or along the surface spanning the pressure surface. Another aspect of the invention is that it operates in conjunction with a charging conveyor delivering material to the press and discharges compressed cake to a discharge conveyor. In another aspect, the invention generally relates to liquid purification or separation and more specifically to processes for accreting suspended constituents as well as controlling the process in response to sensed conditions.

BACKGROUND ART

Many industries produce a wet waste that is sent to landfill. Such wastes arise in processing all types of pulps and vegetable or animal matter. Dewatering is widely practiced in order to reduce the cost of disposal and, often, to overcome regulations that limit the water content of waste that can be accepted. Specifically, in a municipal wastewater treatment plant, wastewater flows into the plant in a canal or the like, and passes through a bar screen that catches solids. These solids must be removed and generally are carried away to landfill. A problem is that the screenings are only about 12% solids and landfill often cannot accept it, due to leaching problems. Thus, there exists a need to dewater and compact those screenings in an efficient way.

An article in Water Environment & Technology, "*How Dry is Dry Enough*?," May 1994, pp. 21–22, illustrates the difficulty in dewatering screenings. This article describes a pilot study in which two stage processing was required to reduce screenings from 12% solids to 50% solids by weight. The first stage, which reduced the mount of organics, consisted of a screenings washing system consisting of an in-tank screen-spiral separator and press with a high-speed washing agitator. The second stage consisted of high pressure dewatering in a ram press that uses a 20,685 kPa hydraulic system to hold washed screenings at 4137 kPa while liquid drained through the press barrel and press gate.

Other devices are reported in patent art. U.S. Pat. No. 4,265,171 to Busse et at. addresses the specific problem of dewatering wet screenings prior to disposal. A drag chain conveys the screenings, and a pressing unit operating above the drag chain presses the water from the screenings. The floor below the pressing unit is pervious and drains the removed water. While such a pressing operation is simple in operation, it requires that the treatment plant build suitable perforated floor area and have linear space for operating a drag chain. Installing such a system could require considerable reconstruction.

Various patents provide specific methods of dewatering sewage sludge. For example, U.S. Pat. No. 4,861,492 to Lehmkuhl et al teaches a method of dewatering sludge by adding flocculating agents and then pressing the sludge in a plate press. A pressing time of 80 minutes produced a product of about 40% sludge solids content. U.S. Pat. No. 5,160,440 to Merai teaches construction of a sludge treatment plant in which sludge is pretreated with a flocculation agent and then pressed in a filter chamber using an inflatable bladder. The sludge then is crumbled and sent to drying belts. U.S. Pat. No. 4,066,548 to Olsen et al dewaters sludge in a continuous process by pressing the sludge between two belts moving at different speeds. U.S. Pat. No. 5,207,907 to DeLons et al teaches a pressing belt for sludge.

Other patents provide methods of dewatering many types of wet products. U.S. Pat. No. 3,073,239 to Cowan et at. teaches an automated bark press that loads batches into a trough. A plunger at the charging end of the trough pushes each batch along the trough, between fixed and moveable plates. As the plunger retracts to receive another load, the moveable plate presses the batch against the fixed plate. The next batch pushes the previous batch further along the trough toward a discharge end, in which manner it may be pressed several times. At the discharge end of the trough, the pressed batch drops onto a transversely extending conveyor belt. U.S. Pat. No. 4,691,628 to Simpson teaches a method of dewatering fibrous material by a system of perpendicular rams that compress the material in a press box. Water is directed away in a series of slots. The dewatered mass is discharged through a door in the press box. U.S. Pat. No. 4,971,693 to Akesaka teaches a method of removing particulate matter from muddy water in a sedimentation tank. The sediment is processed between pressing belts that also lift the sediment from the tank.

These many systems demonstrate the continuing need for efficient ways to dewater wet materials. In particular, it would be desirable to have an apparatus and method for dewatering screenings that can be installed and operate within existing treatment plants, rather than requiring the large scale processing systems often suggested in the prior an. It would be especially desirable to intercept screenings along their pathway from the typical bar screen to the discharge conveyor, without requiring extensive reconstruction of the treatment plant.

In order to efficiently process screenings, it would be desirable to have an apparatus capable of performing the pressing, compacting, and moving operations from a single motive source, with automated operation and adjustable cycle time.

To achieve the foregoing and other objects and in accordance with the purpose of the present invention, as embodied and broadly described herein, the apparatus and method of this invention may comprise the following.

DISCLOSURE OF INVENTION

Against the described background, it is therefore a general object of the invention to provide an improved method and apparatus for dewatering and moving a wet mass, such as screenings.

Additional objects, advantages and novel features of the invention shall be set forth in part in the description that follows, and in part will become apparent to those skilled in the art upon examination of the following or may be learned by the practice of the invention. The object and the advantages of the invention may be realized and attained by means of the instrumentalities and in combinations particularly pointed out in the appended claims.

According to the invention, a dewatering press is provided with a press frame that has both a floored portion that defines a pressing area and a floorless portion that defines a discharge area. The frame carries first and second squeezing elements that are moveable between the pressing area and discharge area. A motive device is connected to the first squeezing element for selectively moving the first squeezing element toward and away from the second squeezing element. A linking device limits the maximum separation of the first and second squeezing elements to a first preselected distance while permitting the first element to approach the second element by less than that preselected distance. A spacer limits the minimum separation of the first and second squeezing elements to a second preselected distance while permitting the first element to move away from the second element by more than the second preselected distance.

The accompanying drawings, which are incorporated in and form a part of the specification illustrate preferred embodiments of the present invention, and together with the description, serve to explain the principles of the invention. In the drawings:

BEST MODE FOR CARRYING OUT THE INVENTION

The invention is a dewatering press 10 for receiving, dewatering, compacting, and discharging screenings in batch operation. Such a press is useful in wastewater processing plants, at the bar screen discharge area. Typically, untreated water enters the plant in a wastewater canal and flows through a bar screen. Large solids, generally referred to as "screenings," are captured on the bar screen. The accumulation of screenings on the bar screen eventually clogs the screen and limits water flow. In response, the water level in the canal is forced to rise at the bar screen. Automated sensors detect the increase in water level at the bar screen and activate a bar screen cleaner. Typically, the bar screen cleaner elevates the screenings from the bar screen and carries them to a bar screen discharge area.

Figure 1:
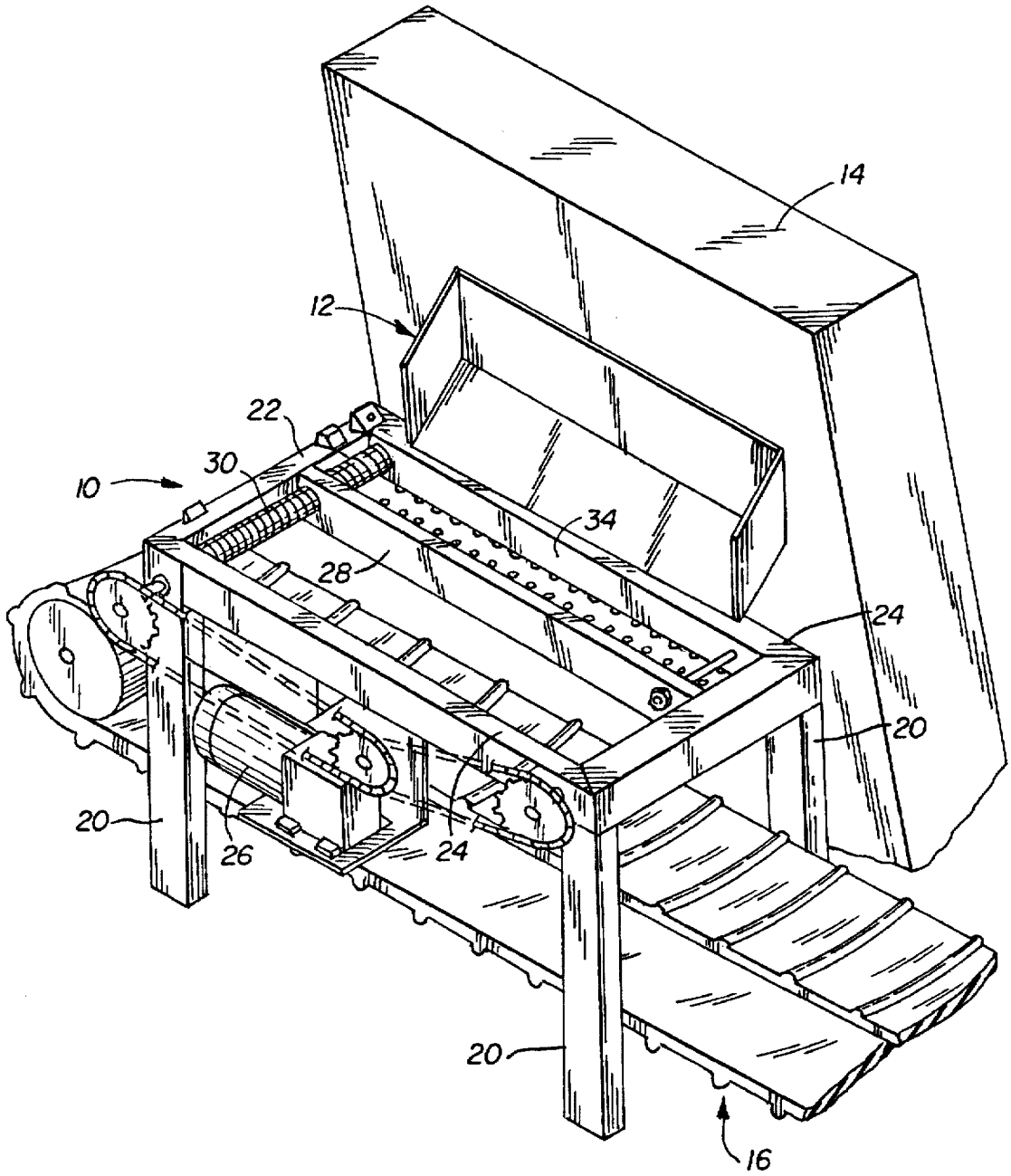
FIG. 1 is an isometric view of a dewatering press and associated equipment, shown in first stage operating configuration for loading screenings.

In FIG. 1, the bar screen discharge area is located below a short slide or discharge chute 12 from an enclosed bar screen housing 14, in which the bar screen cleaner operates. The captured screenings are discharged by gravity at the bar screen discharge area. With the removal of the screenings from the bar screen, the water level in the canal returns to normal. The operation of the bar screen cleaner is intermittent, with the interval depending upon how rapidly the screenings accumulate.

At the bar screen discharge area, typically a removal conveyor 16 is located below the bar screen discharge chute for catching the screenings. The conveyor transports the screenings to a suitable disposal station. Eventually, in many cases, a truck carries the screenings from the wastewater processing plant to a landfill.

The press 10 operates in three stages to receive, dewater, discharge and reset each time it processes a batch of screenings. The press is of a suitable size and configuration to be located over the wastewater canal in many wastewater processing plants. In this location, the press automatically discharges all removed water directly into the wastewater canal. In many plants, the press can be located at the normal bar screen discharge area.

The press provides an area for receiving raw screenings. This reception area of the press can be placed in a suitable position to catch the bar screen discharge. The press provides an area for discharging processed screenings. This discharge area of the press can be placed in a suitable position to discharge the processed screenings directly onto the bar screen discharge conveyor.

In general overview, as shown in FIG. 1, the press 10 is of size and configuration that enable it to be located between the screenings discharge area 12 and the conveyor 16, with a pressing area defined by a perforated panel 18 positioned to receive the screenings. The press can be mounted over the wastewater canal by suitable legs 20 or other supporting means, which can be varied according to the needs of a particular installation. Regardless of how the press is supported, the remaining principal components include a press frame 22, shown as being rectangular with the longer sides 24 oriented to span the canal. Parallel to the longer sides 24, a pair of squeezing elements, bars or plates operate within the press frame and above the level of the perforated panel or screen 18. The perforated screen 18 substantially spans the width of the frame but only a part of the length. The remaining portion of the frame area is open and is a discharge area for processed screenings. The frame carries a suitable driving means, such as motor and gear reducer assembly 26. The motor and gear reducer assembly operate the squeezing bars as described below.

For purposes of description, the longer dimension of the press frame will be referred to as the width, and the shorter dimension will be referred to as the length. The side 24 shown adjacent to the discharge area will be referred to as the front, while the side 24 adjacent to the screen 18 will be referred to as the rear. The shorter sides of the frame will be referred to as left or right, as viewed from the front of the frame. The two squeezing plates serve slightly different functions and may be referred to as the press plate 28 and the discharge plate 34. In parts of the description, the press plate 28 will be referred to as the first plate or Plate A, while the discharge plate 34 will be referred to as the second plate or Plate B.

The squeezing plates are mounted across the width of the frame, parallel to sides 24. The press plate is mounted at its right and left ends on respective right and left drive screws 30, generally known as Acme screws. Suitable driven members, such as right and left mating nuts known as Acme nuts 32, couple the press plate to the frame, such as from a bracket attached to front frame side 24. The motor is connected to the drive screws 30, for example by roller chains and sprockets, for operating the screws in either direction. Screen 18 occupies the rear portion of the frame floor area, while press discharge area 44 occupies the front portion of the floor area.

The first stage of press operation is loading. FIG. 1 shows the pressing area defined over the perforated floor area 18 located immediately below the bar screen discharge chute 12. The front and rear edges of the pressing area are defined by the initial positions of plates 28 and 34. During this first stage loading operation, plate 28 is located near the front edge of the screen 18, while plate 34 is located near the rear edge, adjacent rear frame side 24. The two squeezing plates are located at a preselected initial separation for each other. The bar screen discharge chute loads the press by depositing screenings into this pressing area, on top of the perforated screen 18. The perforations allow excess water or subsequently removed water to drain from the press and return to the wastewater canal. When a batch of screenings has been deposited onto the pressing area, the first stage loading is concluded.

Figure 2:
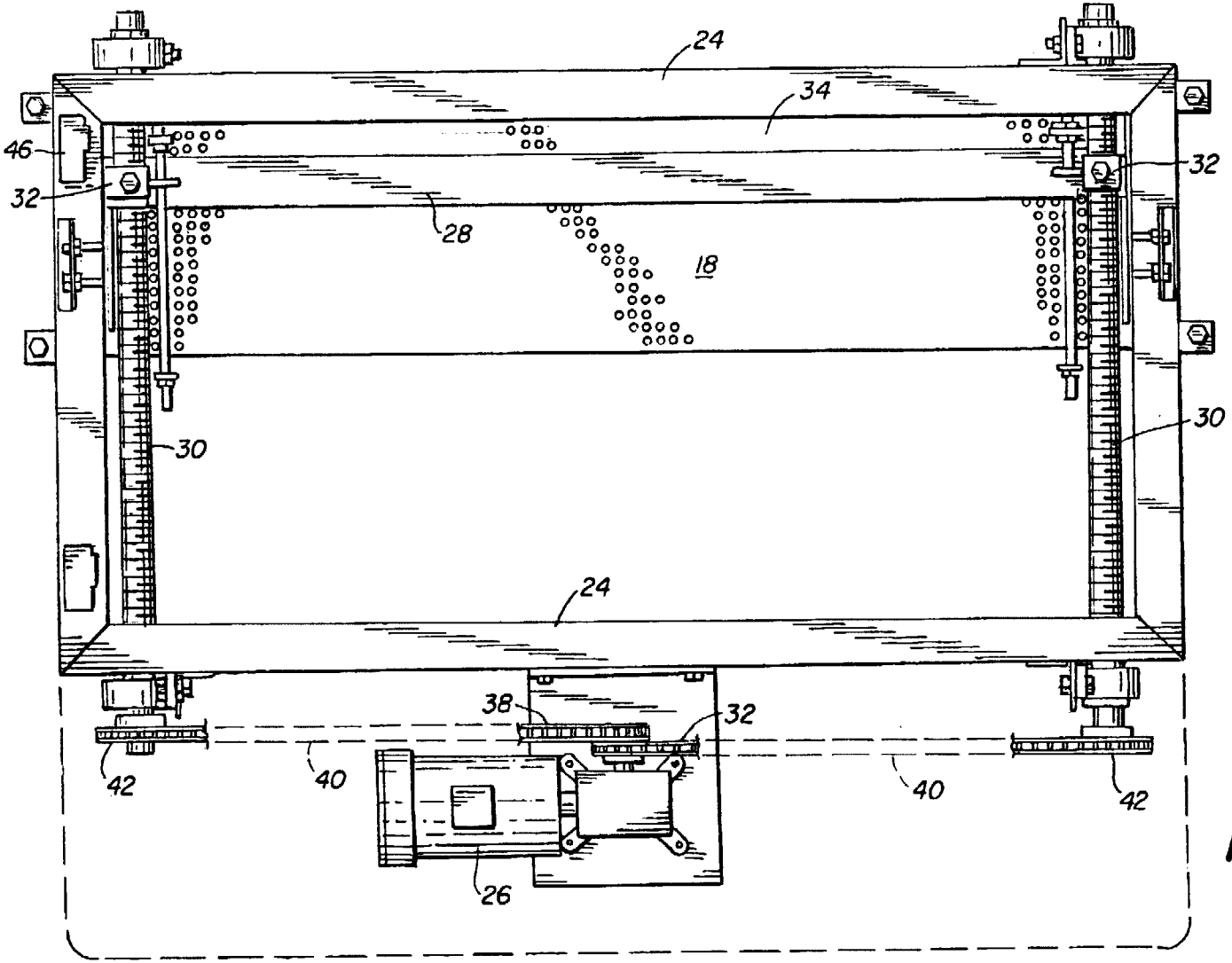
FIG. 2 is a top plan view of the dewatering press of FIG. 1, showing the press in second stage operating configuration immediately after screenings have been dewatered and compacted.
Figure 4:
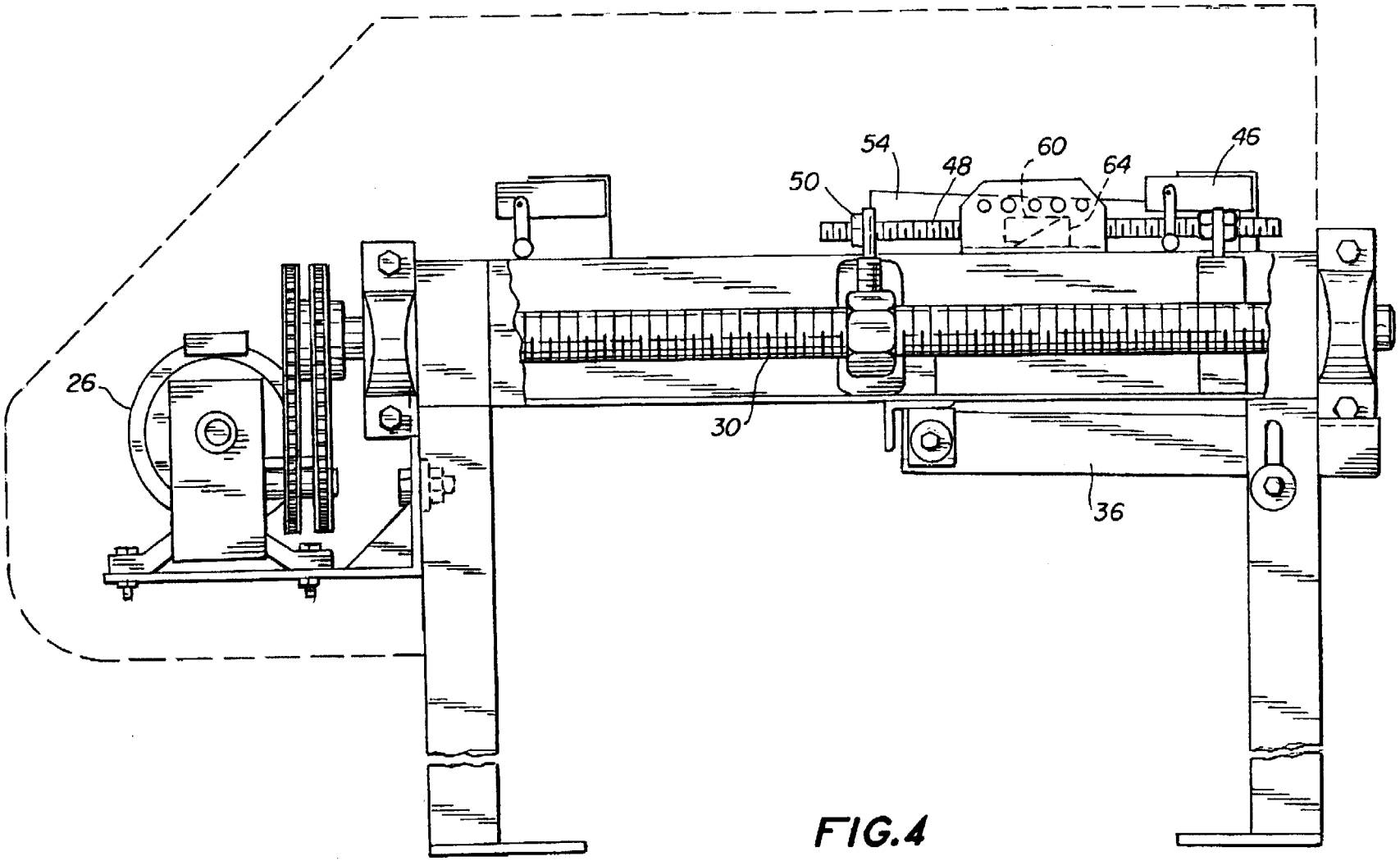
FIG. 4 is a side elevational view of the dewatering press in first stage configuration.
Figure 5A:
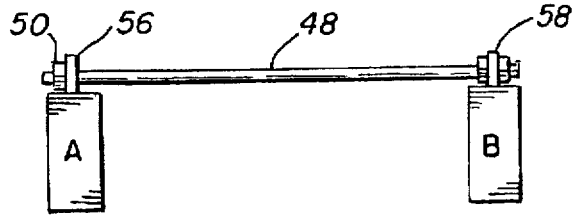
FIGS. 5A–5F are a sequential series of schematic views showing the operation of the adjustable spacing rod.
Figure 5B:
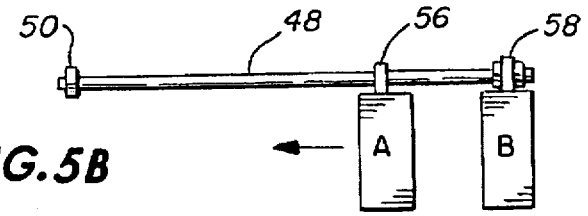
Figure 5C:
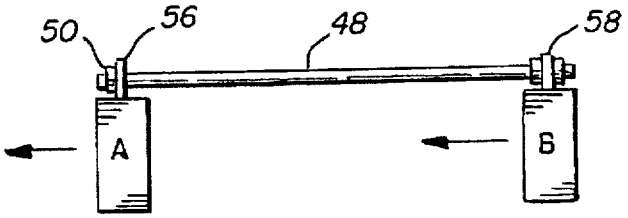
Figure 5D:
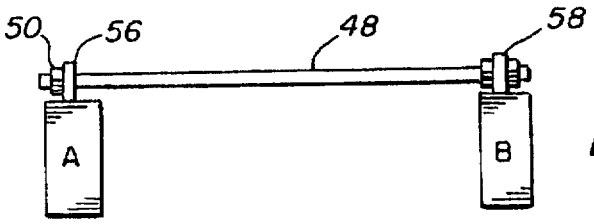
Figure 5E:
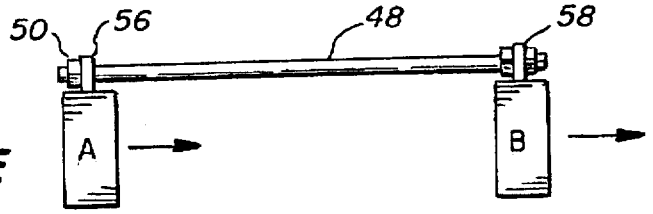
Figure 5F:
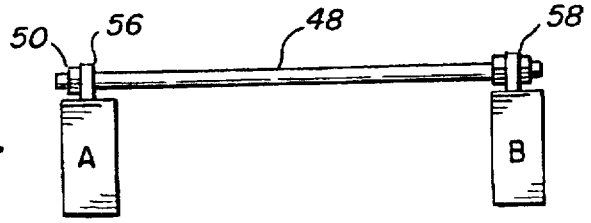
Figure 6A:
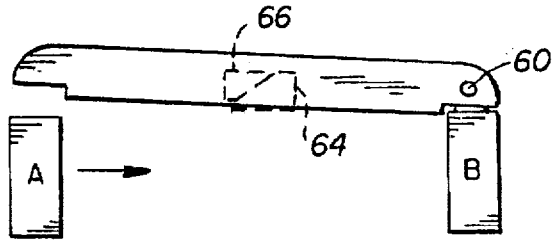
FIGS. 6A–6G are a sequential series of isolated views showing the operation of the release bar.
Figure 6B:
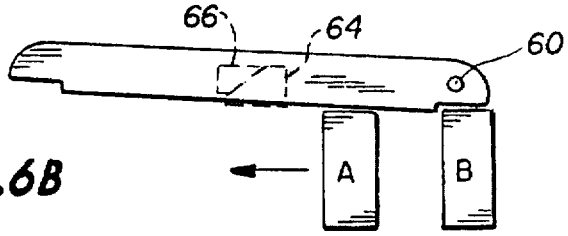
Figure 6C:
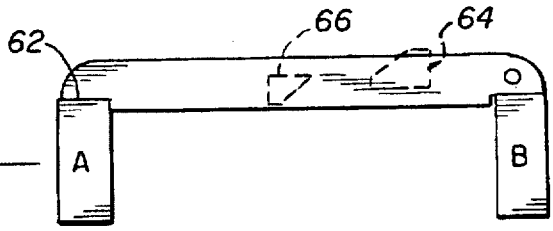
Figure 6D:
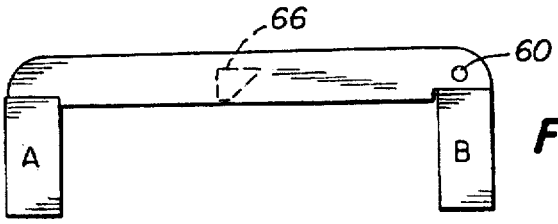
Figure 6E:
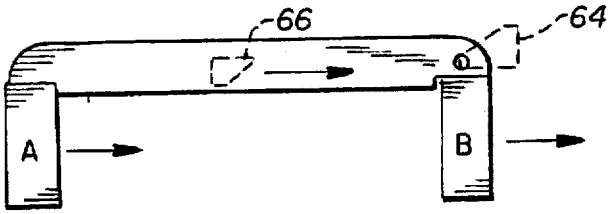
Figure 6F:
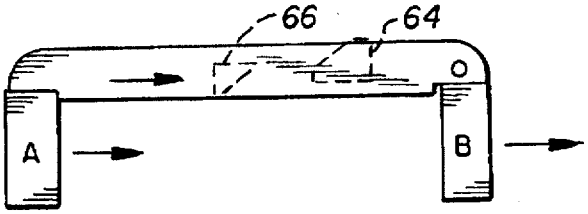
Figure 6G:
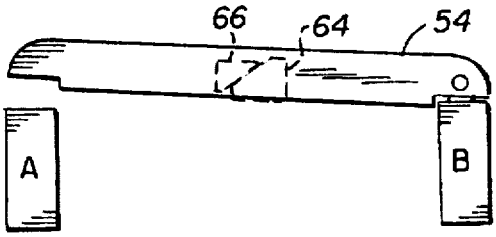

The second stage of operation is the squeezing step, best shown in FIG. 2. In this step, plates 28 and 34 are brought relatively toward each other, squeezing the screenings, removing excess water that subsequently drains through the perforated screen 18. A return chute 36, FIG. 4, is located below the perforated screen 18 and directs the water back into the canal. For example, the return chute may be positioned to drain toward or into the bar screen housing 14.

In greater detail, at the initiation of second stage operation, plates 28 and 34 are located at the same preselected initial separation as in the first stage. Motor 26 rotates sprocket wheels 38 in the frame directions to move plate 28 toward plate 34, rearwardly in the frame from plate 28's initial position. The rotating sprocket wheels 38 drive roller chains 40), in turn rotating driven sprocket wheels 42 that are coupled to the front ends of the Acme screws 30. The screws are operatively connected to press plate 28, to drive it rearwardly over perforated screen 18 and toward plate 34. The latter is immobile during the squeezing operation and rests against rear transverse side 24 of the press frame.

FIG. 2 shows the ultimate possible position of plate 28, which has moved rearwardly over screen 18 and close to or against plate 34. This ultimate position would not be attained if a substantial volume of screenings were present. If such screenings had been present, the motor would cease driving plate 28 when sufficient pressure had been applied to the screenings, as indicated by a sensing means such as a load sensor on the motor. The load sensor detector a high ampere draw and trips an associated micro switch that reverses the motor. Otherwise, plate 28 will strike limit switch 46 carried by frame 22 at a preselected end position of its available movement. Second stage operation is complete and third stage operation commences when plate 28 trips limit switch 46 and reverses the motor.

Figure 3:
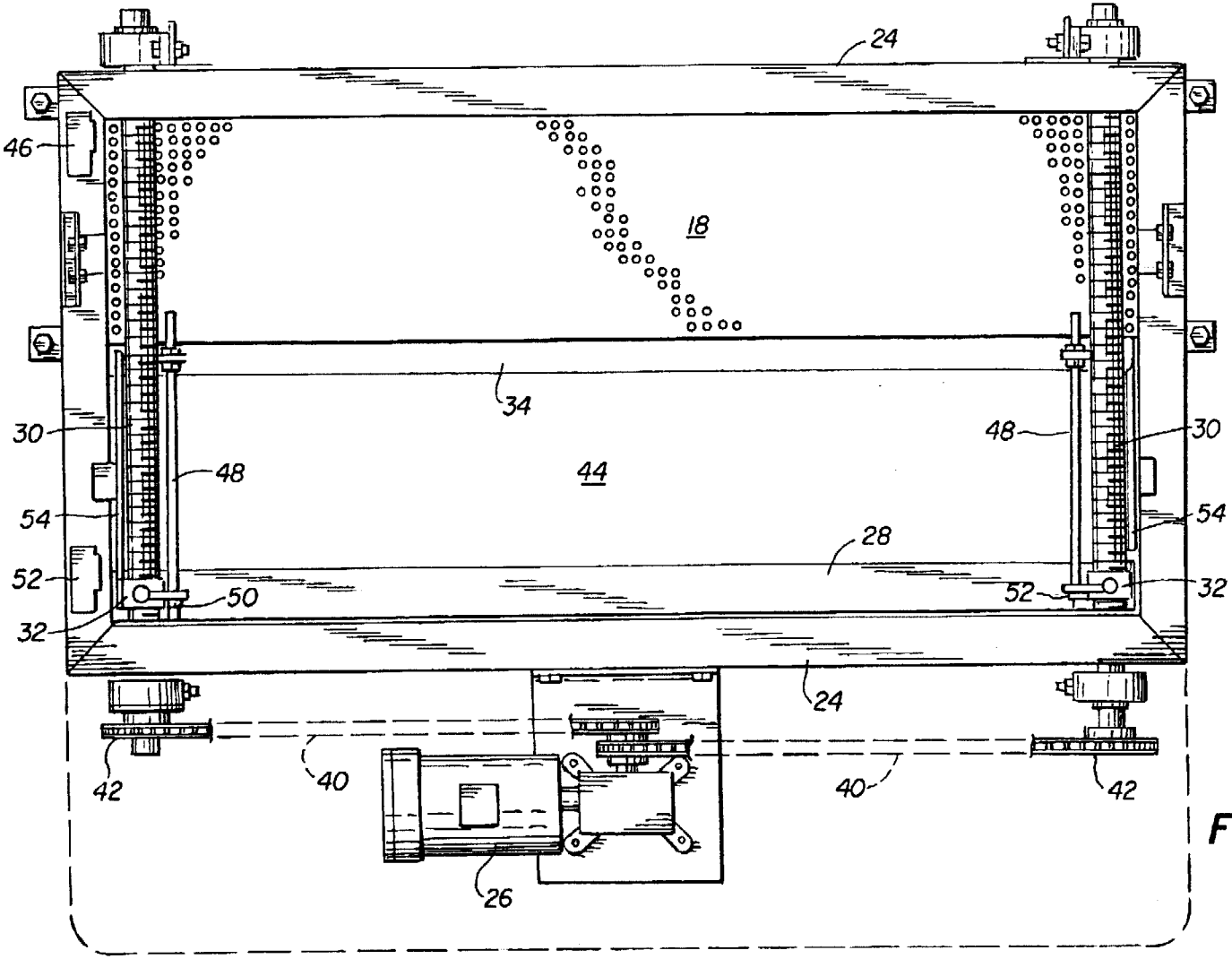
FIG. 3 is a view similar to FIG. 2, showing the press in third stage operating configuration for discharging processed screenings.

At the conclusion of the second stage squeezing operation, the press enters the third stage of operation shown in FIG. 3 by discharging the processed screenings. Plates 28 and 34 move to push the squeezed screenings off the pressing area and to the discharge area, where the screenings drop onto the conveyor 16 for movement to a waiting dump track. The floor of the press frame defines the discharge area 44 across the front portion of the frame. FIG. 3 shows plate 28 and plate 34 now relocated to discharge position. The drive screws 30 move the plates to this position while motor 26 is operating in reverse from second stage operation. The drive screws move plate 28 toward the front of frame 22 from its concluding position of second stage operation. Thus, plate 28 has moved near or against front side 24 of the press frame plate 34 has moved forward over plate 18 to the edge of the discharge area 44. Any processed screenings are moved with the plates and would drop through the open discharge area 44.

During third stage operation, as in second stage operation, only plate 28 is directly powered by the rotating Acme screws 30. However, as is evident, plate 34 performs the discharge function by pushing the compressed screenings forward to the discharge area 44. Plate 34 is moved forward by right and left adjustable spacing rods 48 that are connected to plate 28 in slidable relationship. Thus, at the inception of third stage operation, plate 28 moves forward in frame 22 until reaching its preselected initial separation from plate 34. Thereafter, plate 28 continues forward movement beyond the initial position. However, at initial separation plate 28 catches a stop nut 50 on each rod 48, and the rods pull plate 34 along with plate 28 toward the front of the frame plate 34 pushes the squeezed solids in advance. The plates move off the perforated floor 18 and over the open discharge area 44, where the solids drop onto the underlying conveyor belt 16. At the end of discharge travel, plate 28 strikes another micro switch 52 on frame 22, again reversing the motor. The position of micro switch 52 on frame 22 determines how far plate 28 and plate 34 will travel in the forward direction. The relative position of stop nut 50 on rod 48 determines the relative spacing of plate 28 with respect to plate 34 at the discharge opening.

Third stage operation continues with a return or reset mode, in which Plates 28 and 34 return to their initial positions at their initial spacing. Motor 26 operates via the Acme screws to drive plate 28 rearwardly to its preselected initial position shown in FIG. 1. Plate 28 drives plate 34 rearwardly to plate 34's initial position of FIG. 1, as well. Plates 28 and 34 are maintained at a preselected initial spacing during their return to first stage positions by a pair of right and left release bars 54. These bars are selectively moveable between applied, spacing position and released position. When in applied position, they provide a spacer function by preventing plate 28 from approaching plate 34 by less than a predetermined distance. The release bars are in applied position during the return of Plates 28 and 34 to initial, first stage position, and the predetermined distance maintained by the release bars is the initial spacing between Plates 28 and 34. When the plates have reached initial position, the release bars 54 are moved to released position, and the press is properly configured to begin another cycle. The reset mode of third stage operation is controlled by a timer, which allows a preselected time of motor operation for the plates to return to first stage position. At the conclusion of the preselected time, the timer terminates motor operation, and the third stage operation is concluded.

The schematic sequence of FIG. 5 shows the operation of the adjustable spacing rods 48. The squeezing plates are labeled as A and B. Rod 48 passes through a slip fitting 56 on Plate A and carries adjustable stop nut 50 on the forward end of the rod. The rear end of the rod has a fixed connection 58 to Plate B. Position 5A shows the plates at initial spacing and initial position for first stage loading. Position 5B shows the slip action of fitting 56 as Plate A advances toward Plate B and then withdraws. Rod 48 is inactive during the squeezing stage and the initial separation of the plates. In position 5C, Plate A has withdrawn by more than the preselected initial spacing of plates. Hence, stop nut 50 has engaged the slip fitting 56 and the rod pulls Plate B after Plate A at the distance permitted by rod 48. At position 5D, Plate A has reached the forward extreme of its travel, and the function of rod 48 ends. The plates move through position 5E while returning to initial, first stage position. However, rod 48 is not serving a spacing or pulling function during this return mode. Position 5F is identical to position 5A and shows the completion of the cycles. The rod continues to be without spacing or pulling function at position 5F.

The schematic sequence of FIG. 6 shows the operation of the release bars 54. Once again, the squeezing plates are labeled as A and B. The rear end of the release bar is attached to Plate B on a hinged mounting 60. The front end of the release bar is configured with a notch 62 that is engageable with Plate A for pushing operation. A frame release cam 64, also shown in FIG. 4, is carried on the press frame 22 and controls movement of the release bar from applied to released positions. The release bar carries a cam follower 66 that engages cam 64. In position 6A, the plates are in first stage position as also shown at position 5A. Cam 64 is engaged by follower 66, which lifts follower 66. In turn, release bar 54 is raised, and notched end 62 is not engaged with Plate A. Position 6B is similar to position 5B. Plate A has moved toward Plate B in second stage squeezing operation and then has partially withdrawn. The release bar is non-functional at this point. At position 6C, similar to position 5C, Plate A pulls Plate B through the adjustable spacing rod. As Plate B moves forward from its prior, stationary position, the release bar moves forward with it. Since release cam 64 is stationary on the frame 22, cam follower 66 moves off cam 64. In turn, release bar falls into engagement with Plate A, with notch 62 hooked over the rear face of Plate A. However, at position 6C, the release bar is not functioning to pull or push either plate. Position 6D is similar to position 5D, with the plates at the forward end of their travel. Release bar 54 remains non-functional, although its function is about to start. Positions 6E and 6F show the release bar in operation, spacing Plate B from Plate A as Plate A moves rearwardly under power in the reset mode. At position 6G, similar to position 5F, the plates have returned to their first stage initial position and initial spacing. Cam follower 66 has moved into engagement with cam 64, lifting release bar 54 as Plate B arrived at its starting position. The final movement of Plate A is controlled by timer, with the result that Plate A returns to its starting position without requiting any interaction with the release bar or the adjustable spacing rod. The necessary relationship between the adjustable spacing rod 48 and release bar 54 is that the stop nut 50 be set to allow plates 28 and 34 to separate by a sufficient distance that notch 62 of bar 54 can engage Plate A when the rod is controlling the separation of the plates.

In summary operation, the dewatering press 10 provides a powered and a nonpowered plate, in which the powered plate moves toward the nonpowered plate over a perforated floor and then moves away in reverse direction. At a preselected spacing, the powered plate pulls the nonpowered one in reverse direction, together with the load, via slip arms with stops on them, pulling the load to a discharge area. The powered plate returns both plates to initial position with the assistance of spacer bars that maintain the initial separation of the plates. A cam disengages the spacer bars at initial position, such that the press is ready to repeat its cycle.

The dewatering press is effective and efficient in reducing water content and compacting wastewater screenings. In order to be efficient, and often to meet environmental regulations, the press must be able to increase solids content of processed screenings to at least 50%. A sample of wastewater screenings containing 1000 lb. solids at 15% solids content has a volume of about 3.63 cubic yards. When increased to 25% solids content, the same sample has a volume of about 2.05 cubic yards. At the targeted 50% solids content, the same sample is compacted to 0.92 cubic yards, which is about one-fourth the starting volume. At this reduced volume and water content, the processed screenings are acceptable at landfills. Groundwater leaching is minimal or eliminated. Further, it is possible to incinerate the processed screenings without further dewatering.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be regarded as falling within the scope of the invention as defined by the claims that follow.

I claim:

1. A dewatering press, comprising:

a press frame having a floored portion defining a pressing area and a floorless portion defining a discharge area;

first and second squeezing elements carried by the frame for movement between the pressing area and discharge area;

motive means connected to said first element for selectively moving the first element toward and away from said second element;

linking means for limiting the maximum separation of the first and second elements to a first preselected distance while permitting the first element to approach the second element by less than said first preselected distance; and spacer means for limiting the minimum separation of the first and second elements to a second preselected distance while permitting the first element to move away from the second element by more than said second preselected distance.

2. The dewatering press of claim 1, wherein:

said press frame bounds a substantially horizontal area;

said floored portion is located at one end of the horizontal area;

said floorless portion is located at a second, respectively opposite end of the horizontal area;

said squeezing elements are moveable between a position in which both elements are over the floored portion and a position in which at least said first element is located over the floorless portion and spaced from the floored portion by a sufficient distance that at least a portion of the discharge area is located between the first element and the floored portion.

3. The dewatering press of claim 2, wherein said floored portion comprises a perforated plate, the perforations permitting liquid drainage therethrough.

4. The dewatering press of claim 2, wherein said floored portion comprises a substantially horizontal plate.

5. The dewatering press of claim 2, wherein:

the area bounded by said frame is substantially rectangular, defined by a pair of opposite ends and a pair of opposite sides;

said pressing area is located near one end of the rectangular area;

said discharge area is located near the opposite end of the rectangular area; and said squeezing elements extend between opposite sides of the rectangular area.

6. The dewatering press of claim 1, wherein said motive means comprises a screw drive carded by said frame and drivingly engaged with said first squeezing element.

7. The dewatering press of claim 1, wherein said linking means comprises:

a slidable elongated member engaging said first and second squeezing elements, wherein the engagement of the slidable member with at least one of said squeezing elements is a sliding engagement, allowing the slidable member to slide with respect to at least one squeezing element when the squeezing elements approach each other;

a stop carried by said slidable member at a preselected fixed position outside the squeezing elements and blocking further sliding when the stop contacts a squeezing element, thereby limiting the maximum separation of the squeezing elements.

8. The dewatering press of claim 1, wherein said spacer means comprises:

an interposer selectively and removably placed between said first and second squeezing elements, wherein when placed, the interposer limits the approach of the squeezing elements; and a means for selectively displacing the interposer from between the squeezing elements, wherein when displaced the interposer does not limit the approach of the squeezing elements.

9. The dewatering press of claim 8, wherein:

said interposer is connected to said second squeezing element by a pivot; and said means for selectively displacing the interposer comprises a cam carried from said frame at a preselected position and a cam follower connected to said spacer and engaging the cam at said preselected position, wherein the cam causes the interposer to pivot into a displaced position while the cam and cam follower are engaged.

* * * * *